US005645171A

United States Patent [19]

Felden

[11] Patent Number: 5,645,171

[45] Date of Patent: Jul. 8, 1997

[54] MATERIAL SEPARATOR SYSTEM UTILIZING VACUUM INDUCED AIRFLOW

[76] Inventor: Richard W. Felden, P.O. Box 980243, West Sacramento, Calif. 95798

[21] Appl. No.: 429,861

[22] Filed: Apr. 27, 1995

[51] Int. Cl.[6] ..... B07B 4/00

[52] U.S. Cl. ..... 209/139.1; 209/142; 209/149; 209/154

[58] Field of Search ..... 209/139.1, 138, 209/142, 146, 149, 154, 135, 137

[56] References Cited

U.S. PATENT DOCUMENTS 37,362 1/1863 Siddall ..... 209/139.1

843,783 2/1907 Wilson ..... 209/139.1

1,861,248 5/1932 Stebbins ..... 209/139.1

*Primary Examiner*—David H. Bollinger

*Attorney, Agent, or Firm*—Thomas R. Lampe

[57] ABSTRACT

Apparatus for sorting a plurality of seeds or other objects includes a plurality of separate vertically oriented collection chambers arranged side-by-side. A vacuum source induces an airflow through a vertical column disposed at one side of the plurality of collection chambers and over the open tops of the collection chambers. Discrete objects entrained in the airflow will be apportioned based on one or more characteristics thereof by falling into the collection chambers under the influence of gravity.

13 Claims, 3 Drawing Sheets

MATERIAL SEPARATOR SYSTEM UTILIZING VACUUM INDUCED AIRFLOW

TECHNICAL FIELD

This invention relates to a system for sorting a plurality of discrete objects and separating the discrete objects into separate groups based on at least one physical characteristic of the discrete objects. The invention has application, for example, to the sorting of seeds. The invention may also be utilized in connection with related activities such as cleaning seeds or other discrete objects.

BACKGROUND ART

A number of devices have been utilized in the past to divide a plurality of discrete objects such as seeds into separate groups based on one or more physical characteristics of the discrete objects. A mechanism employed to process and separate seeds into groups is the vibrating table separator which supports seeds and separates and generally classifies the seeds according to size and/or density. Such arrangements are relatively inefficient and expensive and do not provide the degree of reliability one would desire, particularly when processing relatively small and light objects such as seeds. Furthermore, adjustment of such prior art mechanisms to process different types of seeds of other discrete objects is difficult if not impossible.

The invention disclosed in my co-pending U.S. patent application Ser. No. 08/405,802, filed Mar. 16, 1994, is a system utilizing independently variable gaseous flows to sort and separate discrete objects such as seeds into separate groups.

Other prior art arrangements are known wherein seeds and other discrete objects are placed into a moving airflow to clean or otherwise process the seeds and other objects. However, the inventor is not aware of the existence of prior art systems which utilize a vacuum induced airflow to batch or classify seeds or other discrete objects and collect them into a plurality of separate groups, as disclosed and claimed herein.

DISCLOSURE OF INVENTION

The apparatus of the present invention is for sorting a plurality of discrete objects into separate groups based on one or more physical characteristics of the discrete objects.

The apparatus includes a plurality of separate vertically oriented collection chambers arranged side-by-side and defined by chamber side walls and a chamber bottom wall. The collection chambers are open at the upper ends thereof.

Airflow path defining means defines an airflow path in communication with the collection chambers at the upper open ends of the collection chambers. The airflow path defining means includes a hollow, substantially vertically oriented column located at a first side of said plurality of collection chambers and an airflow exit on a second, opposed side of said plurality of collection chambers.

Vacuum applying means is provided for applying a vacuum to the airflow path defining means to induce an airflow upwardly through the hollow, substantially vertically oriented column, over the open upper ends of the collection chambers in seriatim, and out the airflow exit whereby discrete objects entrained in the airflow will be apportioned based on one or more physical characteristics thereof by falling into the collection chambers under the influence of gravity.

Discrete object introducing means is provided for introducing a plurality of discrete objects into the interior of the hollow, substantially vertically oriented column for entrainment by the airflow.

Other features, advantages, and objects of the present invention will become apparent with reference to the following description and accompanying drawings.

BEST MODE FOR CARRYING OUT THE INVENTION

Figure 1:
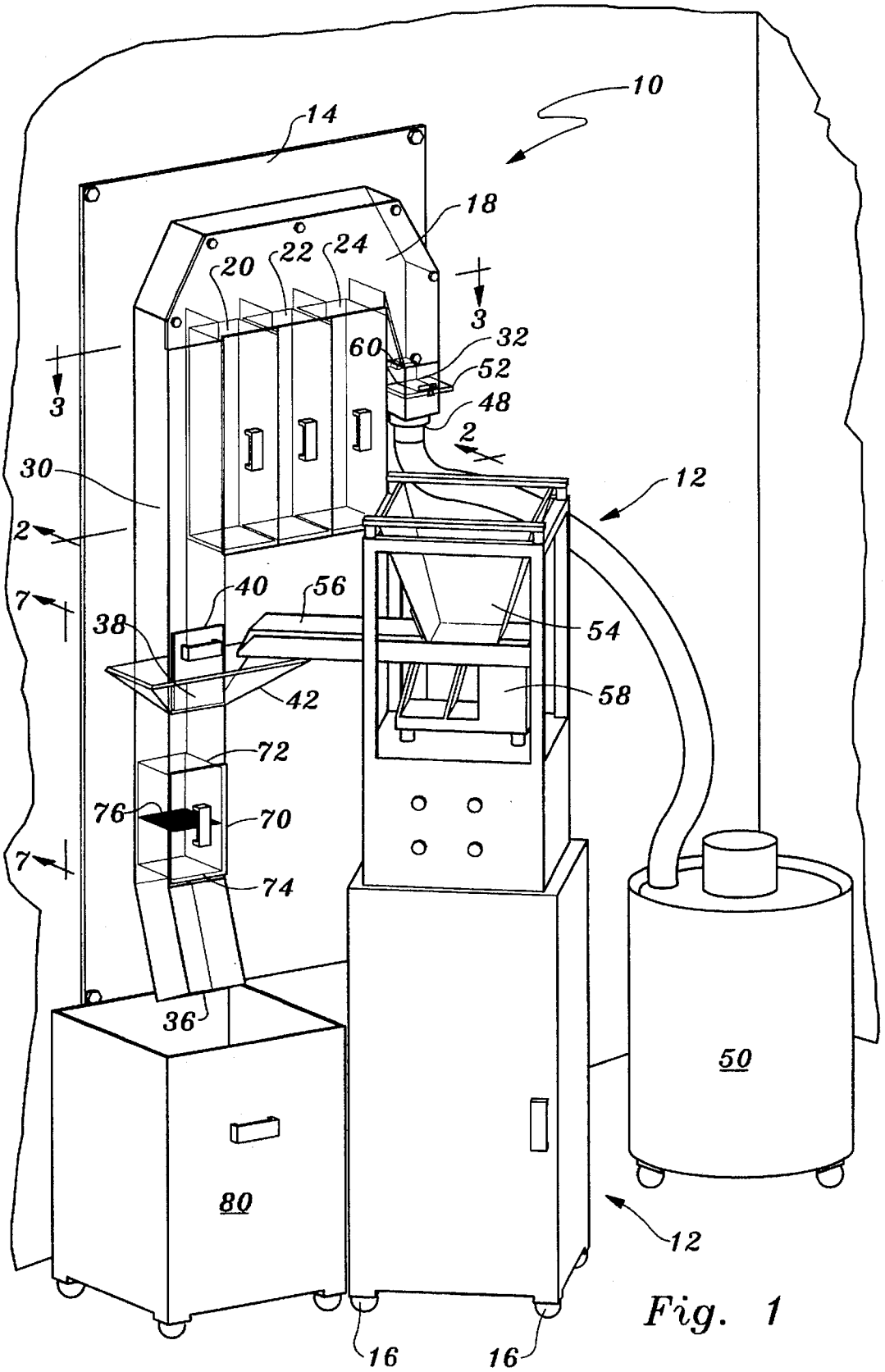
FIG. 1 is a perspective view of apparatus constructed in accordance with the teachings of the present invention.
Figure 2:
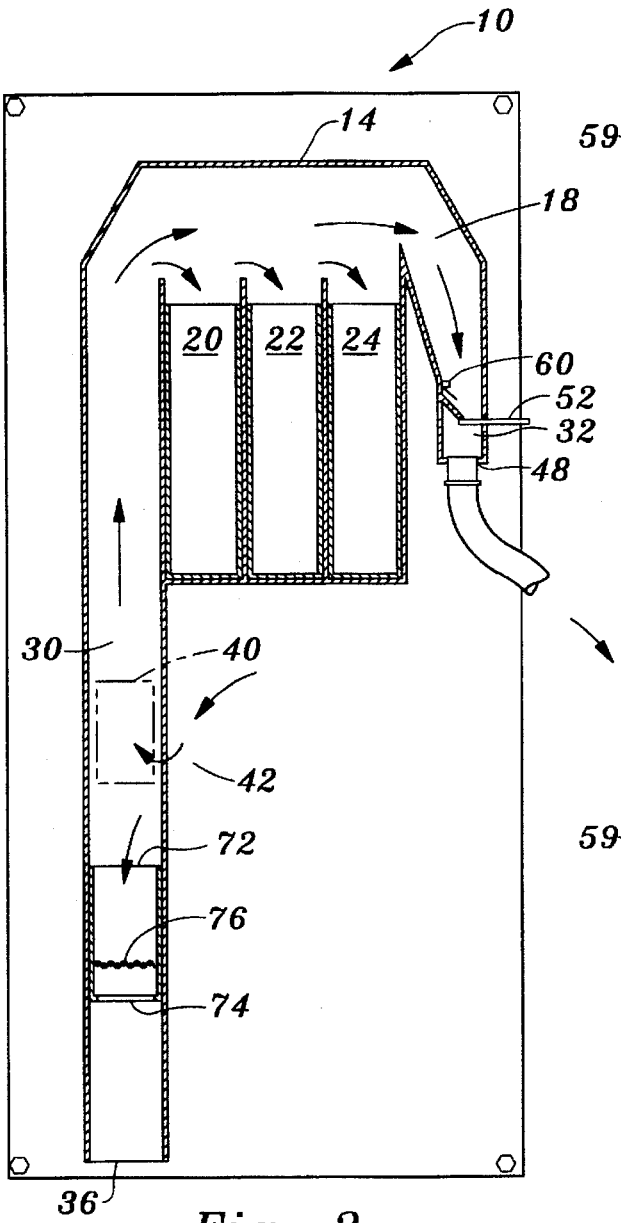
FIG. 2 is a cross-sectional view taken along the line 2—2 in FIG. 1.

Referring now to the drawings, apparatus constructed in accordance with the teachings of the present invention is illustrated. The apparatus includes two principal modules, the first module being designated by reference numeral 10 and the second module by reference numeral 12.

Module 10 is affixed by any suitable means to an upright support such as a wall or panel 14. Module 12 is mobile, including casters or wheels 16 at the bottom thereof.

First module 10 includes a housing 18 formed of clear plastic sheet material or the like accommodating therein three separate collection chambers having a generally box-like configuration. These chambers, also formed of clear material, are designated, respectively, by reference numerals 20, 22, and 24. Handles 26 thereon allow ready removal of the collection chambers from the housing. Each collection chamber is defined by chamber side walls and a chamber bottom wall; however, the collection chambers are open at the upper ends thereof. The collection chambers 20–24 are arranged side-by-side and are vertically oriented, as illustrated.

Located at one side of the plurality of collection chambers is a hollow, substantially vertically oriented column 30 formed of clear plastic sheet material or the like. The column 30 comprises part of the airflow path defining means of the invention, the other parts thereof being that upper portion of the housing 18 extending over the collection chambers and an airflow exit 32 located on the side of the plurality of collection chambers opposed to column 30. The interior of the housing 18 over the collection chamber open upper ends is in communication with the interiors of both the column 30 and the airflow exit 32.

Column 30 defines an air inlet opening 36 at the bottom end thereof. The column additionally defines an inlet opening 38 above air inlet opening 36. An adjustable slide gate 40 can readily be manipulated to vary the size of the inlet opening. Support chute 42 is affixed to the column 30 and has an inner downwardly slanting surface for directing seed or other objects being treated and/or classified to the inlet opening.

A hole 48 is formed in the airflow exit structure at the bottom wall thereof. Hole 48 is for the purpose of receiving the intake hose of a vacuum source, such as that identified by reference numeral 50. This may, for example, be the portable type of equipment commonly referred to as a shop vacuum, however, any suitable vacuum source may be utilized to practice the teachings of the present invention.

A slide or gate 52 is disposed within the airflow exit structure between hole 48 and the top portion of housing 18. The slide or gate can be manually manipulated to adjust the size of the airflow exit interior and thus adjust the amount of vacuum applied to the system by the vacuum source. The gate 52 and related structure are discussed in more detail below.

Actuation of the vacuum source 50 will cause a flow of air through the airflow path defined by column 30, upper portion of housing 18, and the airflow exit 32.

Assuming that seeds are the discrete objects to be separated and classified by the system, the seeds are introduced into inlet opening 38 while airflow proceeds upwardly through column 30. The chute 42 will assist in directing the seeds into the inlet opening. As indicated above, slide gate 40 will be operative to control flow of the seeds into the column interior.

Second module 12 is shown in FIG. 1 in a position to deliver seeds to the chute 42. Module 12 includes a hopper 54, a feeder trough 56 under the hopper, and a vibrator 58 for vibrating the feeder trough to convey seeds therealong to chute 42, it being understood that the feeder trough is angled slightly downwardly toward the chute 42. The vibrator is of any suitable electrically operated type and the cabinet of the second module 42 suitably includes controls for turning the vibrator on or off as well as controlling the intensity of the vibrations thereof.

Figure 4:
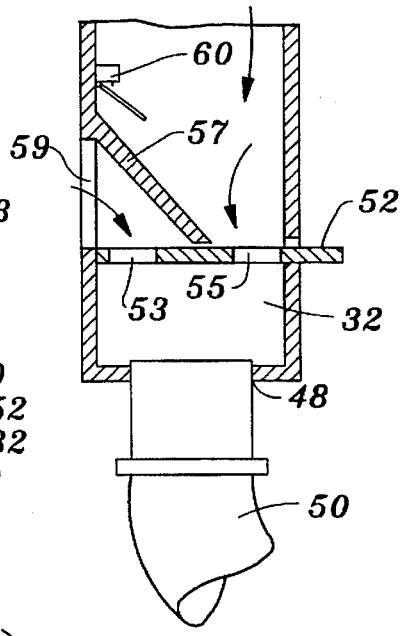
FIG. 4 is a partial sectional view illustrating the apparatus airflow exit and related structure including an airflow detector switch in a condition wherein no airflow exists.
Figure 5:
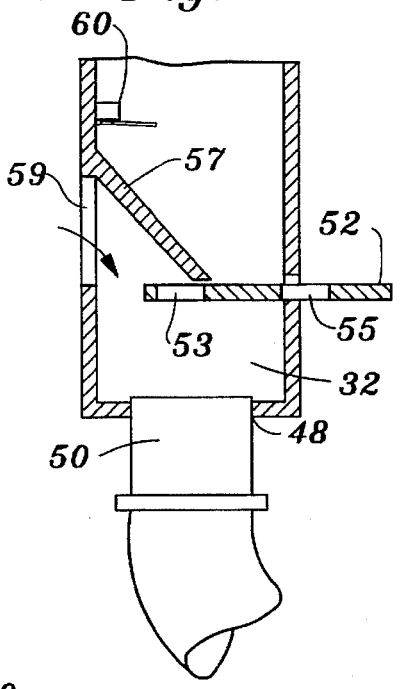
FIG. 5 is a view similar to FIG. 4 but illustrating the airflow detector switch in the position assumed thereby when airflow exists.
Figure 3:
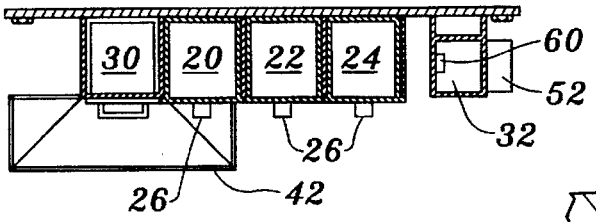
FIG. 3 is a cross-sectional view taken along the line 3—3 in FIG. 1.
Figure 9:
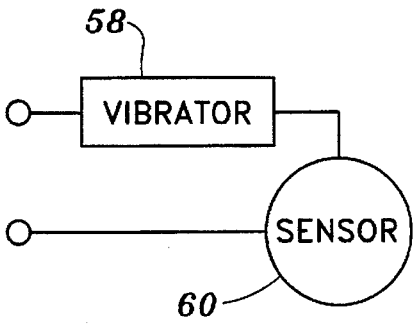
FIG. 9 is a schematic diagram illustrating a vibration and sensor employed in the apparatus in series.
Figure 7:
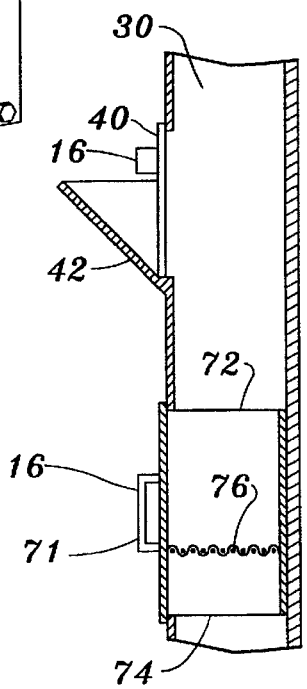
FIG. 7 is a cross-sectional view of the portion of the apparatus defined by line 7—7 in FIG. 1.
Figure 8:
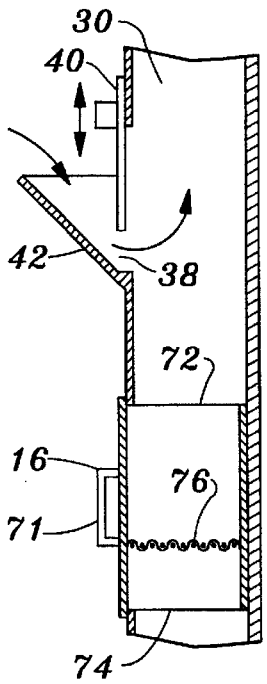
FIG. 8 is a view similar to FIG. 7 but illustrating selected structural components in alternate relative positions.

Referring to FIG. 9, it is seen that the vibrator 58 is in series with a sensor 60 in the airflow path, the sensor 60 being in a nature of a pressure switch of any suitable type which is activated when no vacuum is being applied within the airflow path of the first module. Actuation of the sensor 60 will cause deactivation of the vibrator 58 so that seeds will not be fed into the column 30 when no airflow within the airflow path exists. FIG. 4 illustrates the operating condition when no vacuum is applied to the airflow path and FIG. 5 shows the situation when a vacuum is applied and airflow exists.

The apparatus also includes structure which will allow batch treatment of a small number of seeds or other discrete objects, thus avoiding the necessity of utilizing the second module for small numbers of such objects. In particular, a container 70 having a handle 71 is employed for such purpose. Container 70 has container side walls defining spaced open ends 72, 74 respectively at the top and bottom thereof. A screen 76 is positioned between the side walls and between the open ends of container 70. The container is positionable in the hollow, substantially vertically oriented column 30 whereby airflow in the column will pass through the screen 76 and through the ends 72, 74. In operation, the seeds or other objects are placed on the screen 76 by the operator and the container 70 positioned in place relative to column 30.

Seeds or other objects being treated will be entrained upwardly in column 30 by the airflow induced therein by the vacuum source 50. If the second module 12 is the source of the discrete objects the container 70 will normally not be in position in the column, being replaced by a structure of like configuration but not including a screen.

Objects entrained upwardly by the airflow will exit the top of the column 30 and pass within the interior of the upper portion of housing 18 over the open ends of the collection chambers 20, 22, and 24 in seriatim. All else being equal, the denser objects will fall into collection chamber 20. The least dense objects will fall into collection chamber 26. Objects having intermediate densities will fall into collection chamber 22. Of course, the operator adjusts airflow in the manner previously described by modifying the vacuum applied thereto to "tune" the device to perform the desired separation. Chaff, husks, dirt and other light materials will pass over the collection chambers and proceed to the vacuum source.

A separate discharge container 80 (FIG. 1) may be positioned under air inlet opening 36 to receive objects or materials which are too dense or have other physical characteristics which will not allow them to be entrained upwardly by the airflow in column 30.

Referring once again to gate or slide 52, it should be noted that it defines two openings 53 and 55, the openings being spaced from one another as shown, for example, in FIGS. 4 and 5. The slide 52 passes below the distal end of a baffle plate 57 projecting into the airflow path defined by the airflow exit structure.

Application of a vacuum by vacuum source 50 will tend to draw air through both openings 53 and 55. Opening 53 provides communication between a side opening 59 defined by the airflow exit structure while opening 55 provides communication between the airflow path and the vacuum source. With this arrangement total airflow to the vacuum source 50 will remain essentially the same even when the slide 52 restricts the airflow path. This will prolong the life of the vacuum source motor.

Figure 5A:
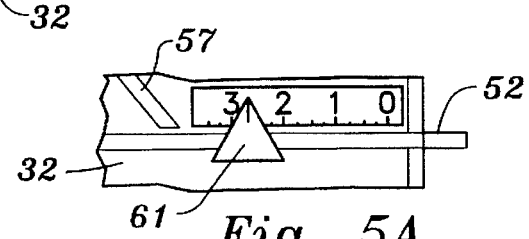
FIG. 5A is a greatly enlarged side view of an indicator employed when controlling airflow.
Figure 6:
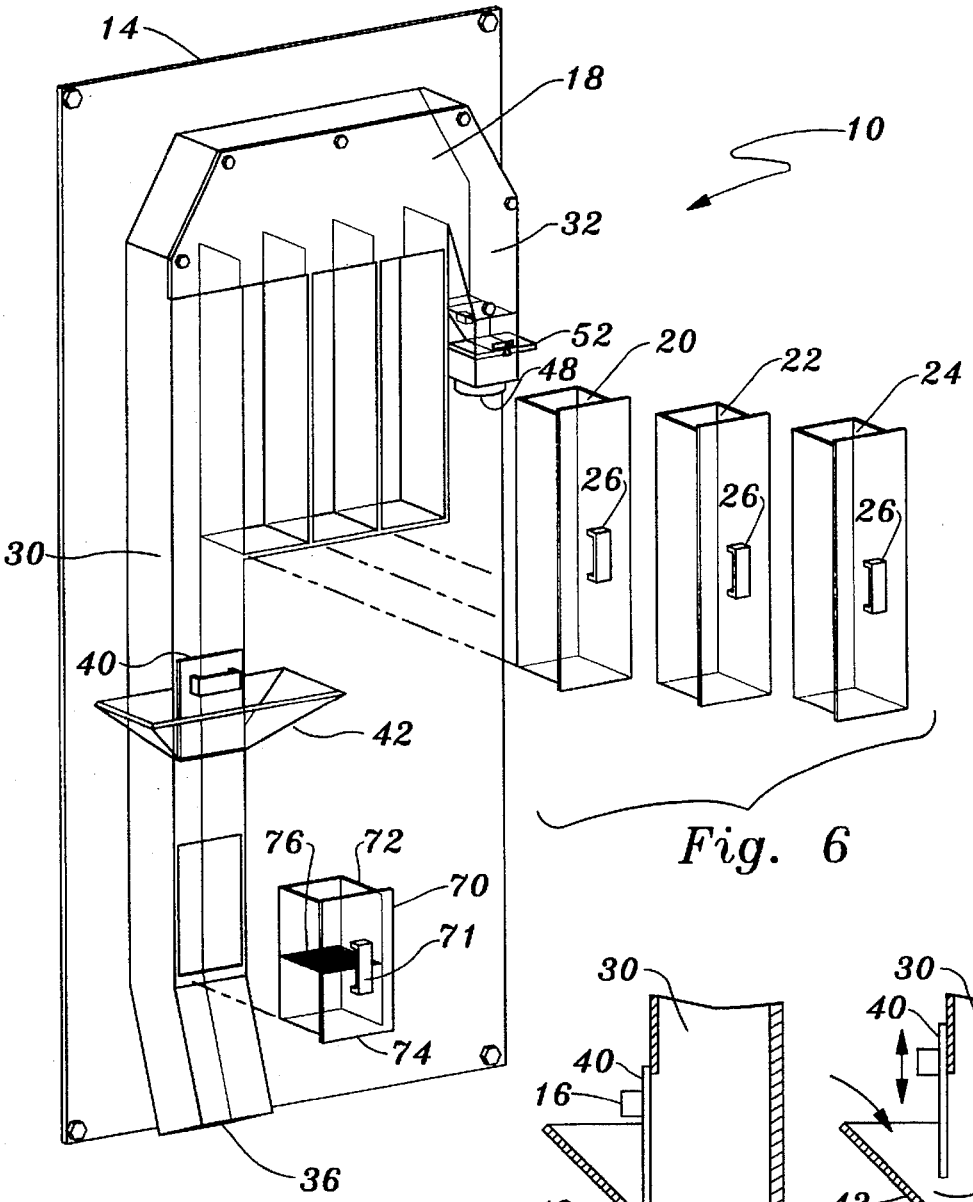
FIG. 6 is an exploded perspective view of the apparatus.

FIG. 5A illustrates an indicator 61 which is affixed to and moves with slide or gate 52. In the arrangement illustrated, numerals are printed or otherwise placed on the airflow exit structure to indicate the position of the slide.

I claim:

1. Apparatus for sorting a plurality of discrete objects into separate groups based on one or more physical characteristics of said discrete objects, said apparatus comprising, in combination:

a plurality of separate vertically oriented collection chambers arranged side by side and defined by chamber side walls and a chamber bottom wall, said collection chambers being open at the upper ends thereof;

airflow path defining means defining an airflow path in communication with said collection chambers at the open upper ends of said collection chambers, said airflow path defining means including a hollow, substantially vertically oriented column located at a first side of said plurality of collection chambers defining an air inlet opening and an airflow exit on a second, opposed side of said plurality of collection chambers;

vacuum applying means for applying a vacuum to said airflow path defining means to induce an airflow upwardly through said hollow, substantially vertically oriented column, over the open upper ends of said collection chambers in seriatim, and out said airflow exit whereby discrete objects entrained in said airflow will be apportioned based on one or more physical characteristics thereof by falling into said collection chambers under the influence of gravity; and discrete object introducing means for introducing a plurality of discrete objects into the interior of said hollow, substantially vertically oriented column for entrainment by said airflow, said discrete object introducing means introducing a plurality of discrete objects into the interior of said hollow, substantially vertically oriented column at a location above said air inlet opening, said hollow substantially vertically oriented column defining an inlet opening at said location, and said discrete object introducing means including a hopper spaced from said hollow, substantially vertically oriented column, support means for supporting discrete objects and conveying discrete objects from said hopper to said inlet and a vibrator for vibrating said support means.

2. The apparatus according to claim 1 additionally comprising an adjustable closure for adjusting the size of said seed inlet opening.

3. The apparatus according to claim 2 wherein said adjustable closure comprises a slide gate.

4. The apparatus according to claim 1 wherein said airflow path defining means includes a housing having a housing interior over and in communication with the open upper ends of said collection chambers, the cross-sections of said airflow path through said hollow, substantially vertically oriented column and through said housing being substantially rectangular.

5. The apparatus according to claim 4 wherein the substantially rectangular airflow path cross-section remains substantially constant along the length of said hollow, substantially vertically oriented column.

6. The apparatus according to claim 1 wherein said support means includes a chute connected to said hollow, substantially vertically oriented column and slanted toward said seed inlet opening.

7. The apparatus according to claim 1 wherein said hollow substantially vertically oriented column has a lower end, said air inlet opening being located at said lower end.

8. The apparatus according to claim 1 including sensor means for sensing termination of application of vacuum by said vacuum applying means and means for deactivating said vibrator when said sensor means senses termination of application of vacuum by said vacuum applying means.

9. Apparatus for sorting a plurality of discrete objects into separate groups based on one or more physical characteristics of said discrete objects, said apparatus comprising, in combination:

a plurality of separate vertically oriented collection chambers arranged side by side and defined by chamber side walls and a chamber bottom wall, said collection chambers being open at the upper ends thereof;

airflow path defining means defining an airflow path in communication with said collection chambers at the open upper ends of said collection chambers, said airflow path defining means including a hollow, substantially vertically oriented column located at a first side of said plurality of collection chambers and an airflow exit on a second, opposed side of said plurality of collection chambers;

vacuum applying means for applying a vacuum to said airflow path defining means to induce an airflow upwardly through said hollow, substantially vertically oriented column, over the open upper ends of said collection chambers in seriatim, and out said airflow exit whereby discrete objects entrained in said airflow will be apportioned based on one or more physical characteristics thereof by falling into said collection chambers under the influence of gravity;

discrete object introducing means for introducing a plurality of discrete objects into the interior of said hollow, substantially vertically oriented column for entrainment by said airflow; and vacuum adjustment means comprising a sliding gate for adjusting the vacuum applied to said airflow path.

10. The apparatus according to claim 9 wherein said airflow exit includes a wall having a wall opening, said slide gate defining two slide gate openings, said slide gate openings being spaced from one another, one of said slide gate openings providing communication between said vacuum applying means and said wall opening, and the other of said slide gate openings providing communication between said airflow path and said vacuum applying means.

11. The apparatus according to claim 9 additionally comprising indicator means for providing a visual indication of the location of said slide gate.

12. Apparatus for sorting a plurality of discrete objects into separate groups based on one or more physical characteristics of said discrete objects, said apparatus comprising, in combination:

a plurality of separate vertically oriented collection chambers arranged side by side and defined by chamber side walls and a chamber bottom wall, said collection chambers being open at the upper ends thereof;

airflow path defining means defining an airflow path in communication with said collection chambers at the open upper ends of said collection chambers, said airflow path defining means including a hollow, substantially vertically oriented column located at a first side of said plurality of collection chambers defining an air inlet opening and an airflow exit on a second, opposed side of said plurality of collection chambers;

vacuum applying means for applying a vacuum to said airflow path defining means to induce an airflow upwardly through said hollow, substantially vertically oriented column, over the open upper ends of said collection chambers in seriatim, and out said airflow exit whereby discrete objects entrained in said airflow will be apportioned based on one or more physical characteristics thereof by falling into said collection chambers under the influence of gravity; and discrete object introducing means for introducing a plurality of discrete objects into the interior of said hollow, substantially vertically oriented column for entrainment by said airflow, said discrete object introducing means introducing a plurality of discrete objects into the interior of said hollow, substantially vertically oriented column at a location above said air inlet opening, and said discrete object introducing means comprising a container having container side walls defining spaced open ends and a screen positioned between said side walls and between said open ends, said container being positionable in said hollow, substantially vertically oriented column whereby said airflow will pass through said screen and through the spaced open ends.

13. Apparatus for sorting a plurality of discrete objects into separate groups based on one or more physical characteristics of said discrete objects, said apparatus comprising, in combination:

a plurality of separate vertically oriented collection chambers arranged side by side and defined by chamber side walls and a chamber bottom wall, said collection chambers being open at the upper ends thereof;

airflow path defining means defining an airflow path in communication with said collection chambers at the open upper ends of said collection chambers, said airflow path defining means including a hollow, substantially vertically oriented column located at a first side of said plurality of collection chambers and an airflow exit on a second, opposed side of said plurality of collection chambers;

vacuum applying means for applying a vacuum to said airflow path defining means to induce an airflow upwardly through said hollow, substantially vertically oriented column, over the open upper ends of said collection chambers in seriatim, and out said airflow exit whereby discrete objects entrained in said airflow will be apportioned based on one or more physical characteristics thereof by falling into said collection chambers under the influence of gravity; and discrete object introducing means for introducing a plurality of discrete objects into the interior of said hollow, substantially vertically oriented column for entrainment by said airflow, said collection chambers comprising removable collection chambers.

* * * * *